US006158368A

United States Patent [19]

Nanami

[11] Patent Number: 6,158,368

[45] Date of Patent: Dec. 12, 2000

[54] FUEL DELIVERY FOR SMALL PLANING WATERCRAFT

[75] Inventor: Masayoshi Nanami, Shizuoka, Japan

[73] Assignee: Yamaha Hatsudoki Kabushiki Kaisha, Japan

[21] Appl. No.: 09/404,160

[22] Filed: Sep. 27, 1999

[51] Int. Cl.[7] ..... B63B 35/73

[52] U.S. Cl. ..... 114/55.5; 440/88

[58] Field of Search ..... 123/311, 579; 440/88, 38; 114/55.5

[56] References Cited

U.S. PATENT DOCUMENTS

| | | | |
|---|---|---|---|
| 3,824,975 | 7/1974 | Bastow | 123/504 |
| 4,160,425 | 7/1979 | Curtis | 440/88 |
| 5,386,145 | 1/1995 | Boswell | 261/41.1 |
| 5,846,102 | 12/1998 | Nitta et al. | 440/88 |
| 6,027,384 | 2/2000 | Nitta et al. | 440/88 |
| 6,029,639 | 2/2000 | Mashiko | 440/88 |

*Primary Examiner*—Stephen Avila
*Attorney, Agent, or Firm*—Bacon & Thomas PLLC

[57] ABSTRACT

A small planing personal watercraft including a hull, a straddle-type seat atop the deck of the hull, and a four cycle engine located internally of the hull is provided with one or more engine air intake tubes extending approximately horizontally in the hull in its normal flotation position. A carburetor supplying fuel to the engine intake air is located in the intake tube with a pivoting throttle valve located in the carburetor. The pivot axis of the throttle valve is oriented vertically relative to the carburetor and intake tube. An access opening is provided above the engine and various fuel control elements are disposed so they are readily accessible through the access opening. A carburetor may have an integrated fuel pump located on the upper side of the carburetor, fuel lines may be located on the upper side of the carburetor and a throttle control linkage including a cable sheave may be located on the top side of the carburetor, all of which will be readily available for expedited maintenance through the access opening above the engine. If the carburetor utilizes a fuel bowl having a float therein for controlling flow of fuel to the bowl, the pivot axis of the float may be oriented horizontally in a fore and aft direction or may extend transversely of the hull to avoid pitching or rolling motions affecting undesired flow of fuel into the fuel bowl. Precise control over fuel delivery is thus provided to enable maintenance over engine emissions.

8 Claims, 15 Drawing Sheets

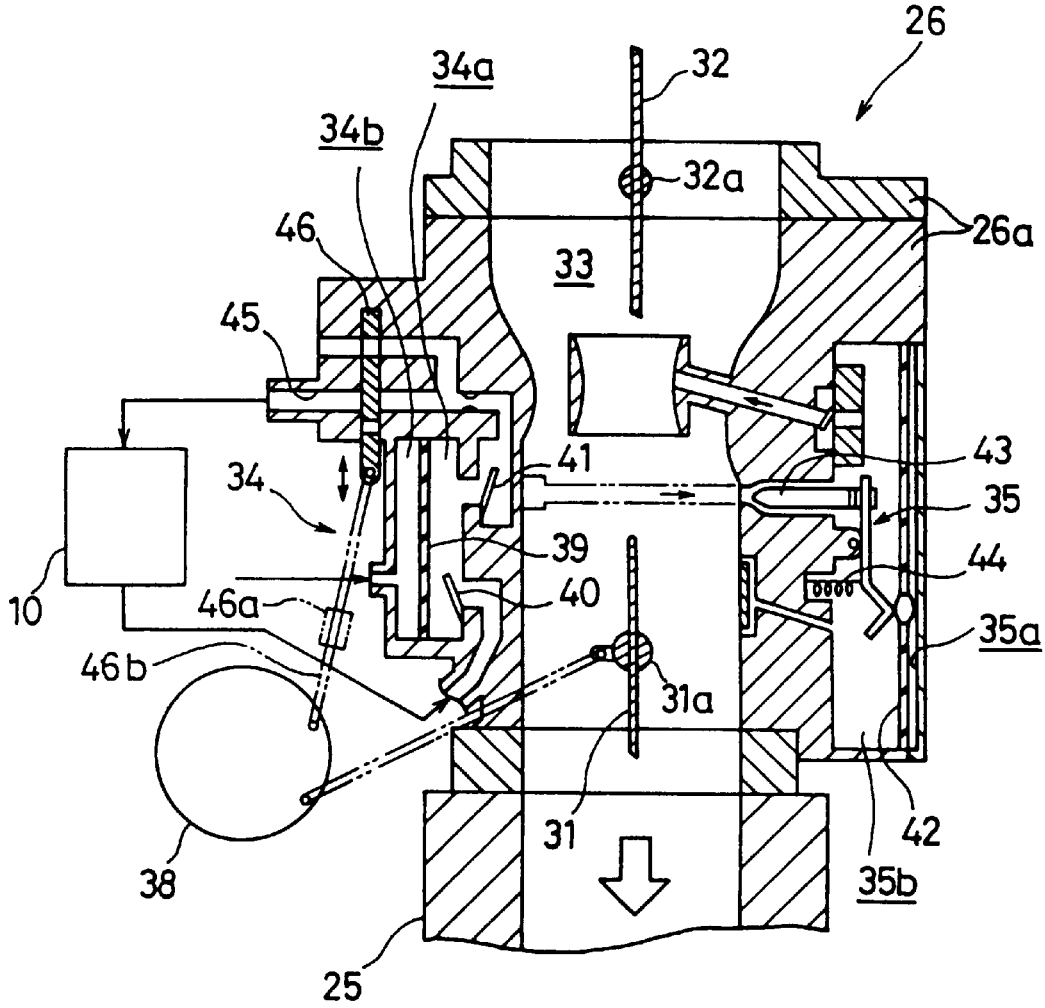
FIG. 6
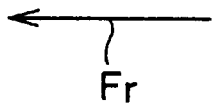

FUEL DELIVERY FOR SMALL PLANING WATERCRAFT

BACKGROUND OF THE INVENTION

1. Field of the Invention

The present invention generally relates to small planing personal watercraft powered by four-cycle engines, and, more particularly, to fuel delivery for such watercraft.

2. Description of Related Art

In recent years, four-cycle engines have been proposed to improve exhaust emissions in small planing personal watercraft which are typically operated by a rider straddling a seat and steering with handlebars.

However, precise fuel delivery is required in order for four-cycle engines to produce clean exhaust. In the past, carburetors have generally been used to supply fuel to engines used in small planing watercraft. Both float-type carburetors having a float chamber, and so-called floatless carburetors using a pump integrated with the carburetor to deliver fuel to the carburetor air intake passage have been used. To control a throttle valve in the carburetor a throttle control cable wound over a throttle control sheave is typically used.

However, when floatless carburetors are used, depending on the way the fuel lines are connected to the fuel pump and the positioning of a sheave around which the throttle control cable is wound, it is difficult to maintain precise control of the fuel delivery and maintenance access to the carburetor area can be limited. For example, the fuel line may be in direct contact with, or routed around, peripheral equipment so that when making adjustments to the carburetor, the throttle cable may accidentally become crimped, or its position may inhibit performing carburetor adjustments to adjust the fuel/air mixture. Furthermore, the throttle control mechanism may be obstructed by peripheral equipment, making it difficult to perform maintenance on the mechanism or proper adjustment of the carburetor.

On the other hand, when a float type carburetor is used, depending upon the orientation of the pivot axis of the float in the float bowl or chamber, unwanted fuel may flow into the float chamber when the watercraft abruptly changes position, causing the fuel level in the chamber to rise and the rate of fuel delivery to the air intake passage to be undesirably increased.

BRIEF SUMMARY OF THE INVENTION

The present invention addresses these and other problems associated with conventional technology by enabling and facilitating precise adjustments of the carburetors of such watercraft so as to assure cleaner exhaust emissions for the watercraft.

In one embodiment, a small planing watercraft is fitted with a four-cycle engine mounted with air intake tubes having portions extending transversely of the watercraft hull and approximately horizontally with the hull when the watercraft is in its normal flotation position. An access opening from outside the watercraft hull is provided in the engine deck above the engine. The engine is equipped with floatless carburetors, each having a throttle valve and a fuel pump connected to the horizontal portion of each engine air intake tube. The orientation of the carburetor throttle valve axis is vertical in the carburetor and vertical in the intake air tube, and the fuel pump is mounted above the carburetor with the fuel lines adjacent the carburetor arranged over the carburetor so that they can be visually examined and maintained through the aforementioned access opening. In this embodiment, it is possible to extend one's hand through the opening above the engine and easily grasp a fuel line in order to perform maintenance, such as adjusting a bending radius in such fuel line.

In another embodiment, a four-cycle engine is mounted in a small planing watercraft with its air intake tube having a portion extending approximately horizontally and transversely within the hull of the watercraft and with an access opening from outside of the watercraft hull located in the deck above the engine. Floatless carburetors are installed on the horizontal area of the engine air intake tubes with the axes of the valve shafts of the throttle valves being vertical inside the carburetor and inside the horizontal air intake tubes. The throttle valve shaft of each carburetor is linked to a sheave around which a throttle control cable is wound with its other end connected to a throttle lever. The sheave is located above the carburetor where it can be visually examined and accessed through the opening. In this embodiment, a hand can pass through the access opening above the engine for easily making adjustments in the connection area between the throttle cable and the sheave.

In another embodiment, a four-cycle engine is mounted with its air intake tubes extending approximately horizontally and transversely in the watercraft hull and an access opening from the outside of the hull is provided above the engine carburetors. The carburetors are equipped with a throttle valve and an integrated fuel pump to deliver fuel from the fuel tank to the carburetor air intake tube, with the carburetor connected to the horizontal area of the air intake tubes. The axis of the shaft of each throttle valve extends parallel with the crankshaft of the engine and the fuel pump is mounted at the top or bottom side of the carburetor above or below the respective air intake tube, with the fuel lines positioned above the carburetor where they can be visually examined through the opening. In this embodiment, the fuel lines may be easily accessed through the access opening in order to perform maintenance, such as adjusting a bend radius in a fuel line.

In another embodiment, the carburetors include float bowls or chambers and are connected to a four-cycle engine. A fuel line is connected to each carburetor float bowl and a fuel level controlling needle valve connected to a pivoting float maintains the fuel at a constant level within the float bowl. The float pivots around an approximately horizontal axis extending fore and aft within the float bowl. The needle valve which is linked to the movement of this float opens and closes the fuel outlet of the fuel supply line. In this embodiment, sharp pitching of the watercraft will not cause significant pivoting of the float.

In another embodiment, the float type carburetors for the engine are connected to a four-cycle engine so that fuel lines are connected to the float bowls of the carburetors and a needle control valve maintains the fuel at a constant level within each float bowl. The control valve includes a pivoting float which pivots around an approximately horizontal axis within the float bowl and a needle valve is linked to the movement of this float and which opens and closes the fuel outlet of the fuel supply line. In this embodiment, the direction of the float's pivot axis extends transverse across the watercraft. In this embodiment, sharp rolling of the watercraft will not cause significant pivoting of the float.

The phase "air intake tubes extending approximately horizontally" includes air intake tubes that are bent slightly or are slightly sloping relative to the horizontal. Furthermore, "positioning the fuel lines above the carburetor" means that the majority of the fuel lines adjacent the carburetor should be positioned above the carburetor. In addition, "the area that can be visually examined through the access opening" includes not just the area that lies directly beneath the opening, but also that area which can be seen when viewed at an angle through the opening.

DESCRIPTION OF THE DRAWINGS

The invention will now be described with respect to the drawings wherein the Figures have been labeled with numerals to identify similar features throughout each of the figures, and wherein:

FIG. 6 is a sectional view of one of the carburetors;

FIG. 7(*b*) is a side view of the carburetor shown in FIG. 7(*a*);

FIG. 10(*b*) is a side view of the carburetor shown in FIG. 10(*a*);

FIG. 14(*b*) is a side view of the carburetor shown in FIG. 14(*a*)

DETAILED DESCRIPTION OF PREFERRED EMBODIMENTS OF THE INVENTION

Figure 1:
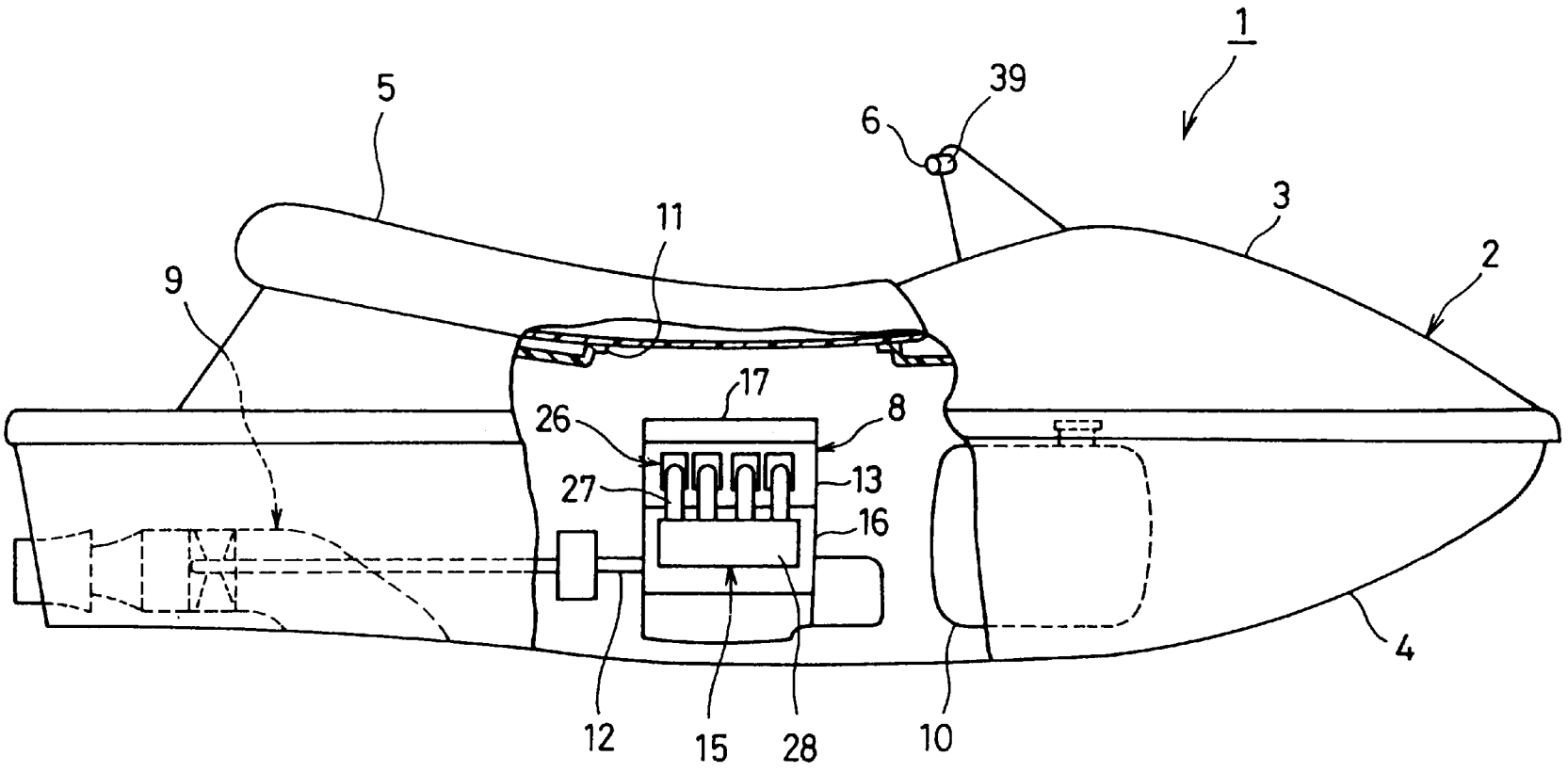
FIG. 1 is a partial cutaway side elevational view of a small planing personal watercraft embodying the present invention.
Figure 2:
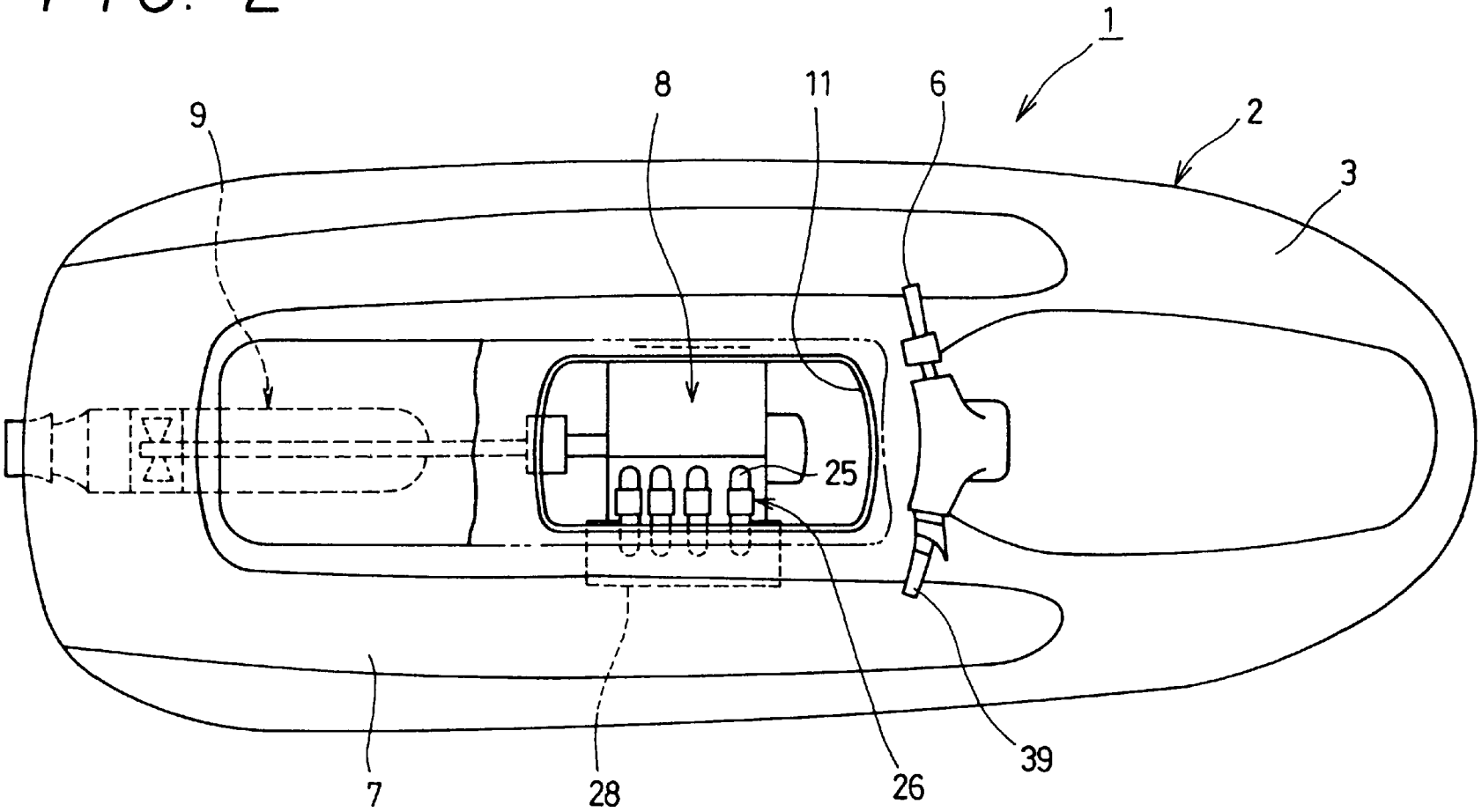
FIG. 2 is a plan view of the watercraft.
Figure 3A:
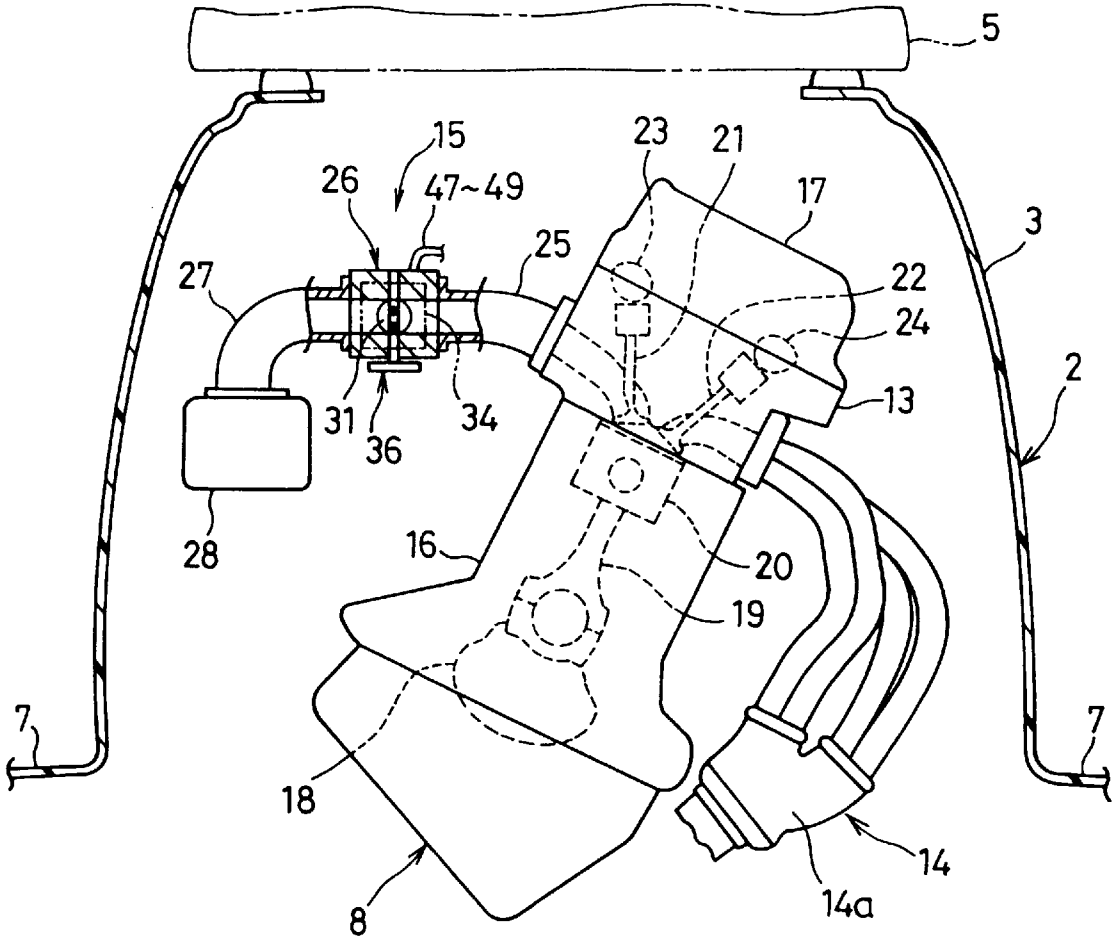
FIGS. 3*a* and 3*b* are a transverse partial cutaway view of an engine compartment of the watercraft showing a carburetor and a detail of the carburetor, respectively.
Figure 3B:
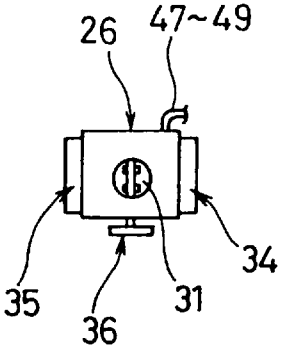

A first embodiment of a small planing personal watercraft incorporating the present invention is shown in FIGS. 1–6. In these figures, the watercraft 1 has a hull 2 including a seat 5 for the rider which is movably or even removably attached to the deck portion 3. In front of the seat is a pair of steering handle bars 6 which are grasped by the driver when operating the watercraft 1. As shown in FIG. 2 and 3, the deck portion 3 includes footrests 7 formed on both sides of the seat 5 for supporting the rider's feet.

Inside the watercraft 2 is an engine 8, a conventional water jet propulsion device 9 that is driven by the engine 8, and a fuel tank 10. An access opening, or hatch, 11 is formed in the deck 3 preferably vertically above the engine and under the seat 5 to provide access to the interior of the hull 2 to enable maintenance to be performed on the engine 8. During operation of the watercraft 1, the opening 11 is covered by the seat 5.

In accordance with this embodiment, the engine 8 is a water-cooled, DOHC 4-cylinder engine and is mounted generally upright in the hull so that the crankshaft 12 extends along the fore and aft direction of the watercraft 1, usually centered along its transverse width. As shown in FIG. 3, the axes of the engine cylinders, when viewed from the front of the chassis 2 tilt upwardly. The exhaust system 14 is mounted on the port, or left, side of the engine head 13 while the air intake system 15 is connected on the starboard , or right, side. FIG. 3 illustrates various other parts of the engine 8, including the cylinder head 13, the cylinder block 16, the cylinder head cover 17, the crankshaft 18, the connecting rod 19, the piston 20, the intake valve 21 (see FIG. 3*a*), the exhaust valve 22, the intake valve camshaft 23, and the exhaust valve camshaft 24.

The exhaust system 14 merges the exhaust passages from the four cylinders into an exhaust pipe 14*a* that is connected to a conventionally water lock (not shown) in the pump chamber that houses the propulsion apparatus 9.

The air intake system 15 includes air intake ducts or tubes 25 running approximately horizontally and transversely in the hull in its normal flotation position and to each cylinder head along the starboard side. Floatless carburetors 26 connected to the horizontal area of these air intake tubes 25 and an air intake silencer 28 are connected to the upstream side of the carburetors 26 through an air intake duct 27. The air intake duct 27 is curved 90° with the air intake silencer connected to it at its lower end.

As best shown in FIG. 6, each carburetor 26 includes a pivotable butterfly throttle valve 31 and a choke valve 32 upstream of the throttle valve. An integrated fuel pump 34 is located toward the forward side of the craft on the left side of the air intake passage 33 for the carburetor 26 shown in FIG. 6. On the rearward side of the carburetor 26 is a mixture adjustment valve 35. In FIG. 6, the arrow labeled "Fr" indicates the forward direction of the watercraft, while the direction of air intake flow is shown by the larger arrow. In FIG. 3, the choke valve 32 is omitted.

Figure 4:
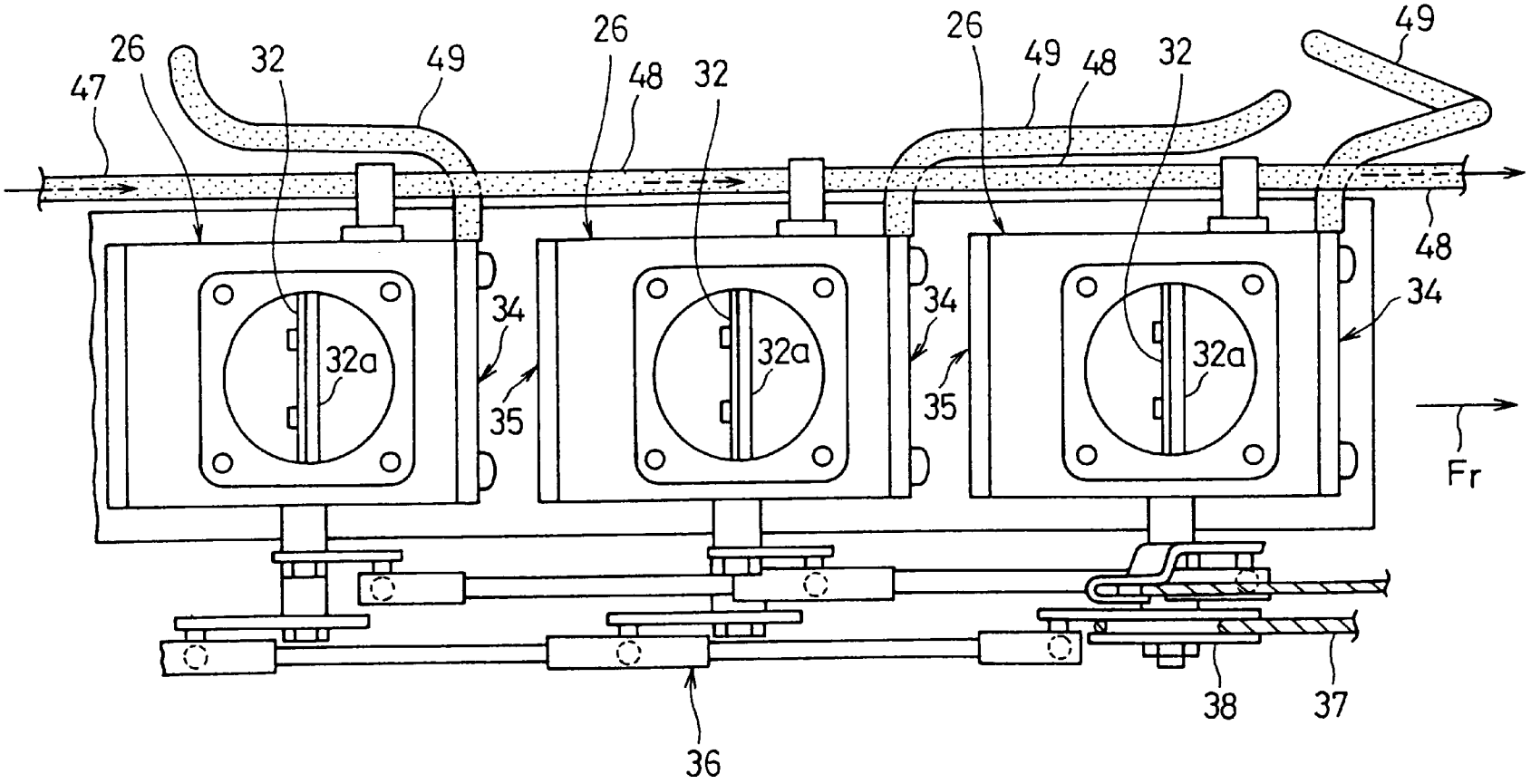
FIG. 4 is a side view of three carburetors shown from the starboard side of the watercraft with the silencer and air intake ducts not shown.

As shown in FIG. 6, the valve pivot shafts 31*a*, 32*a* of the throttle valve 31 and choke valve 32, respectively, are mounted vertically and are free to turn inside their corresponding carburetor bodies 26*a*. As shown in FIG. 4, the lower ends of the valve shafts 31*a*, 32*a* are connected by a linkage mechanism 36 with the throttle valves 31 and choke valves 32 of the other carburetors 26. The linkage mechanism 36 includes a throttle cable sheave 38, located at the end of the line of carburetors 26. In this embodiment, the sheave 38 is arranged on the side of the carburetor located towards the front of the watercraft; however, it may also be arranged on the opposite side towards the rear of the watercraft. A throttle control cable 37 is wound around the sheave 38 and is connected at one end to the watercraft throttle lever 38, shown in FIGS. 1 and 2 for operating the sheave 38 and the throttle valves.

As is shown in FIG. 6, the integrated fuel pump 34 includes an inside pump chamber 34*a* and an outside pump chamber 34*b* which are separated by a flexible diaphragm 39. Pulses corresponding to the engine RPM are applied to the outside pump chamber 34*b*, while in the inside pump chamber 34*a* draws fuel from the fuel tank 10 which is then expelled through the flow or mixture adjustment valve 35 described below. Check valves 40 and 41 are installed in the inlet and outlet, respectively, of inside pump chamber 34*a*.

The flow adjustment valve 35 includes an inner chamber partitioned by a diaphragm 42 into an atmospheric chamber 35*a* and a fuel chamber 35*b*. When sufficient suction is applied to the fuel chamber 35*b*, the valve body 43 overcomes the force exerted by the compressed coil spring 44, and opens. The fuel chamber 35*b* is then connected to the outlet of the fuel pump 34. This outlet for the fuel pump 34 is also connected to a fuel return passage 45 which returns to the fuel tank 10 any surplus fuel not flowing through the flow adjustment valve 35 and into the carburetor 26. Midway in the fuel return passage 45 is a sliding cutoff valve 46 which can be switched to a position that directs the surplus fuel to the fuel tank 10 or to a fuel enrichment nozzle (not shown). The sliding cutoff valve 46 is connected by a coil spring 46*a* through a linkage 46*b* connected to the sheave 38 so that the fuel enrichment nozzle opens into the inside wall surface of the air intake passage in order to increase the supply of fuel during rapid acceleration.

Figure 5:
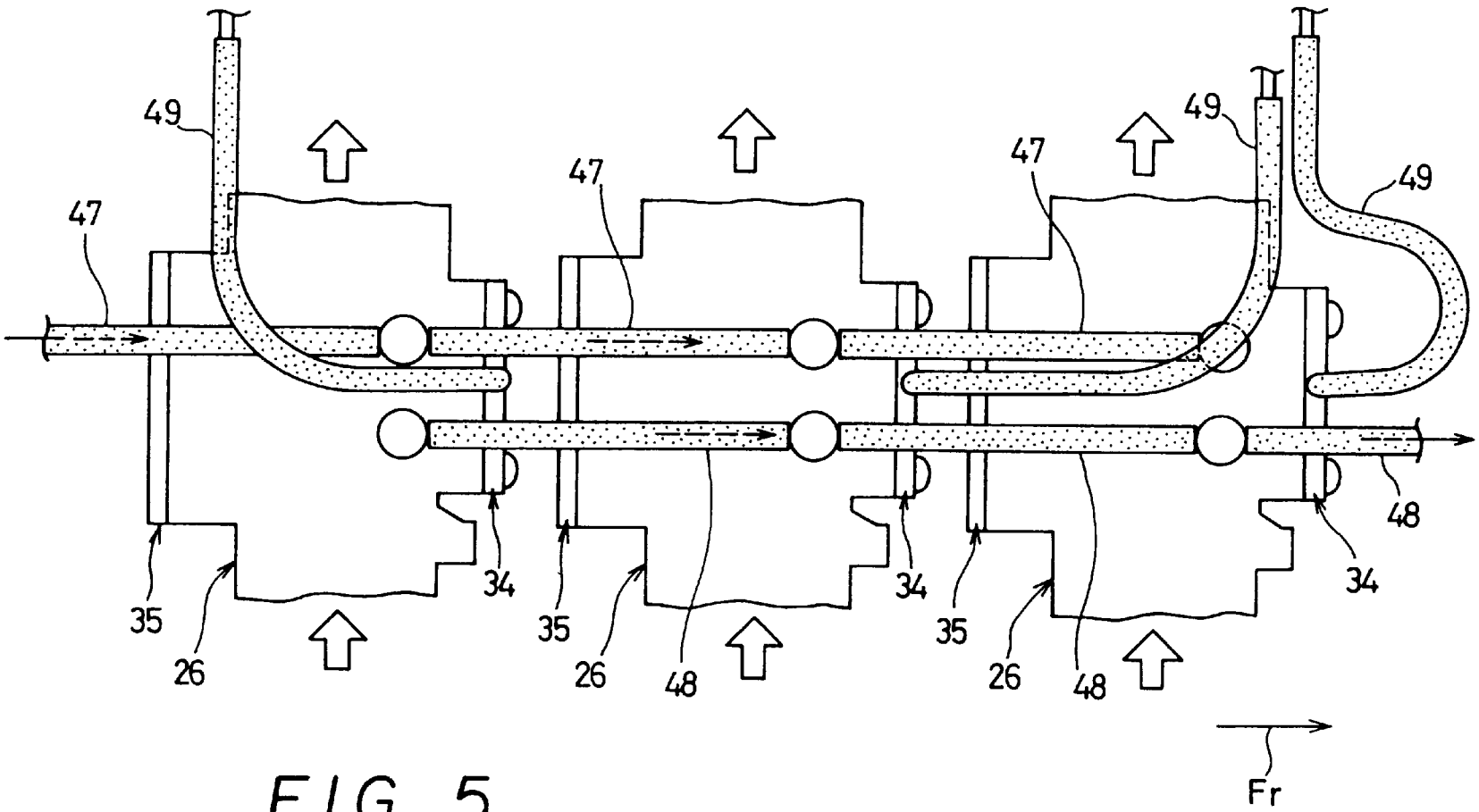
FIG. 5 is a plan view of the carburetors shown in FIG. 4.

As best shown in FIGS. 4 and 5, the floatless carburetor 26 is equipped with fuel lines 47–49 running above the carburetor adjacent the fuel pumps; the lines feed fuel, return surplus fuel from the carburetor 26 to the fuel tank, or increase the amount of fuel supplied during rapid acceleration. The fuel lines 47 supply the fuel to the pumps of each respective carburetor 26. The fuel line 48 returns surplus fuel to the fuel tank 10, and the fuel line 49 is used to increase the flow of fuel during rapid acceleration. In the illustrated embodiment, the fuel lines 47–49 run on top of and are connected to each carburetor 26, where they can be visually examined through the overhead access opening 11 over the engine. The fuel lines 47–49 need not all lie directly beneath the opening 11, as shown in FIG. 2, but are observable and accessible through the opening and are not shielded by other engine parts.

Maintenance may be performed on the carburetors 26 of the watercraft 1 by removing the rider's seat 5 from the chassis 2 in order to expose the opening 11. Maintenance on the fuel lines 47–49 can be easily performed by reaching through the opening and grasping the lines, in order to, for example, adjust their bend radius. Since the state of the fuel lines 47–49 can be visually checked by looking through the opening 11, one does not need to grope blindly around for the lines.

Inspection of the fuel lines 47–49 makes it possible to ensure that the lines are not pinched so that a precise amount of fuel is delivered by the carburetors 26 to the engine 8 in order to provide clean exhaust emissions.

Furthermore, in accordance with this embodiment, adjustments (i.e., idle screw, etc.) of the carburetor 26 and reattachment of fuel lines 47–49 which can be especially complicated for multiple carburetors and fuel lines can be easily performed.

Figure 7A:
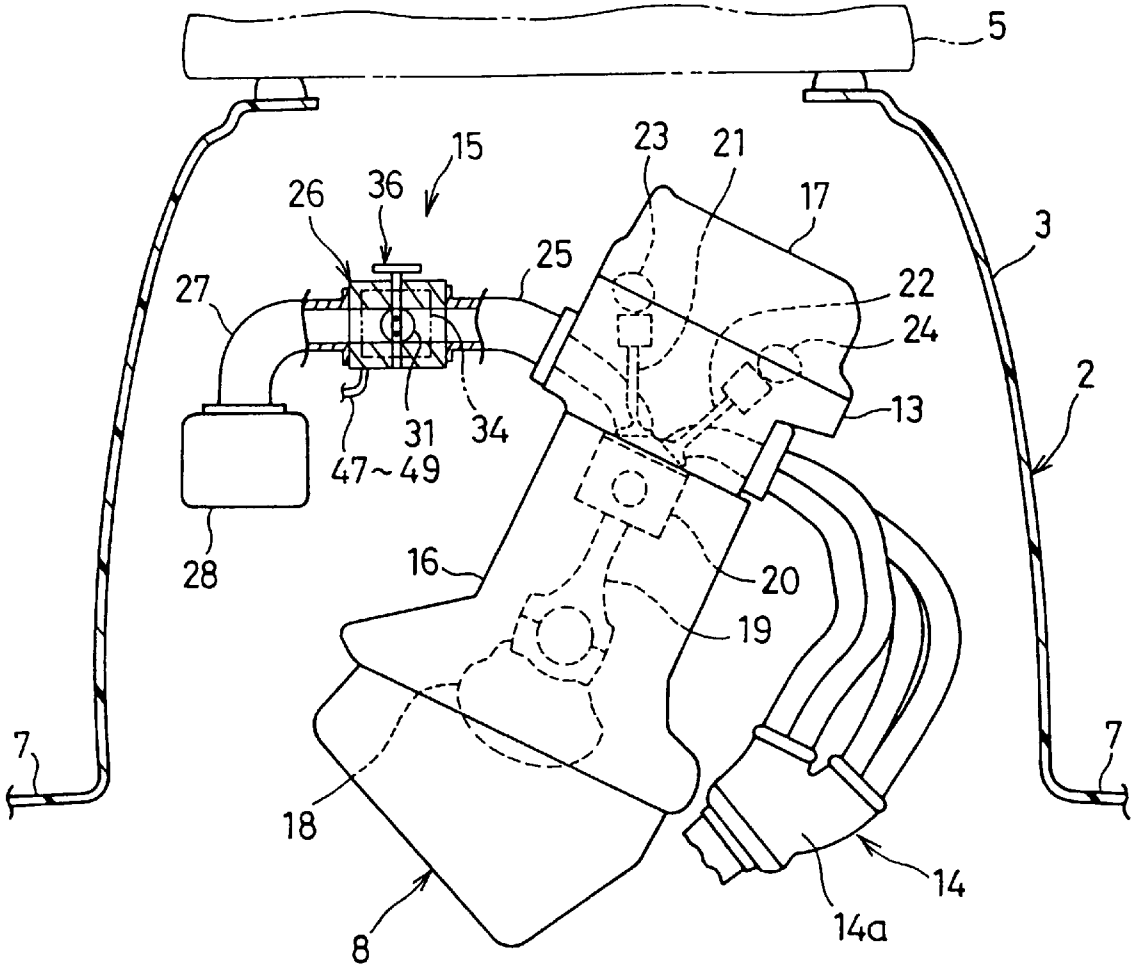
FIG. 7(*a*) is a transverse sectional view of an engine compartment of another embodiment of a watercraft with a partial cutaway view of a single carburetor.
Figure 7B:
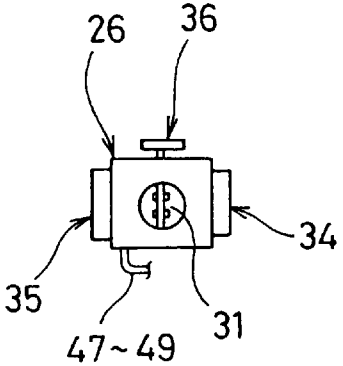
Figure 8:
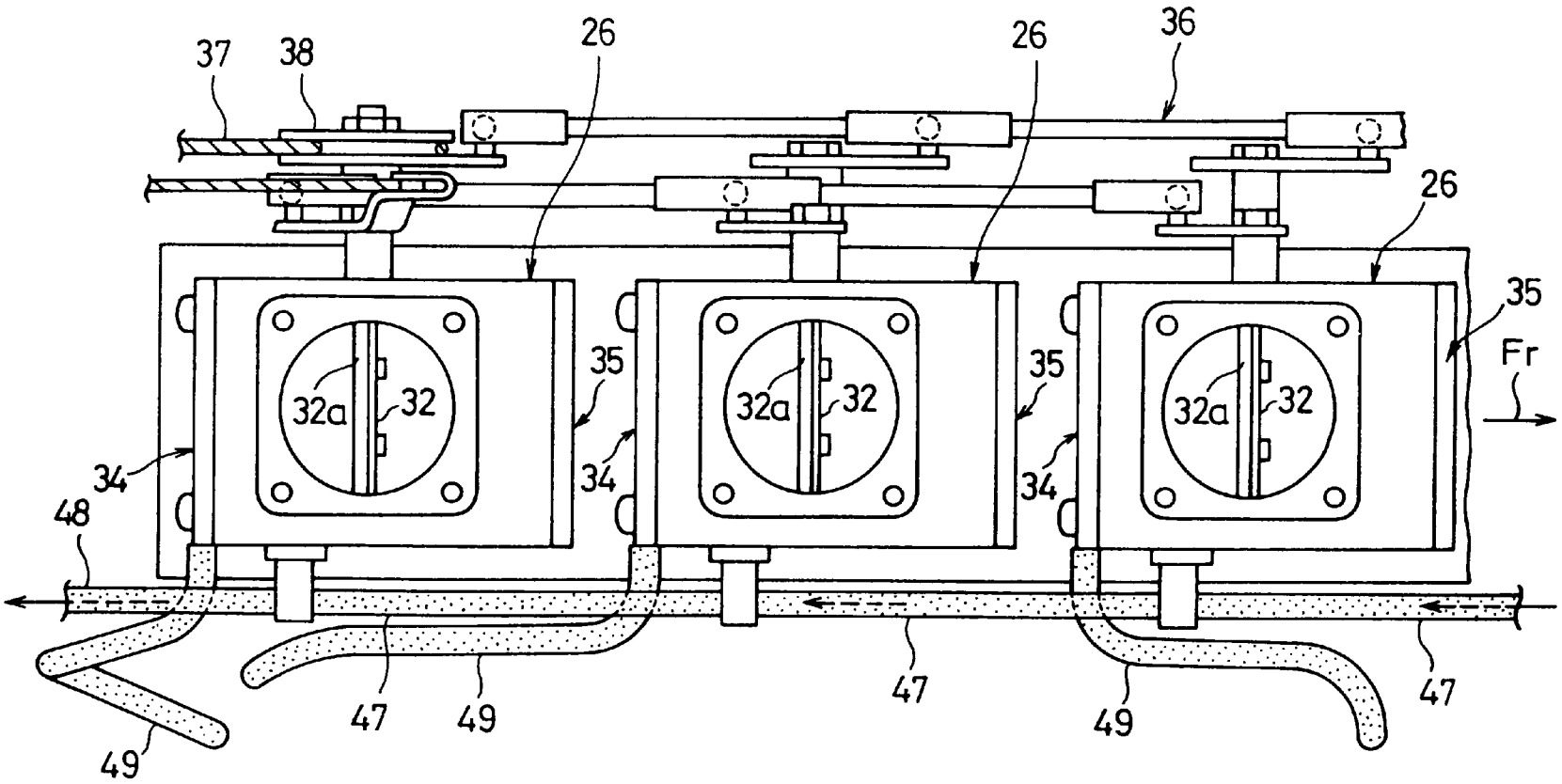
FIG. 8 is a side view showing three carburetors from the starboard side of the watercraft illustrated in FIG. 7(*a*), wherein the silencer and air intake ducts have been removed.
Figure 9:
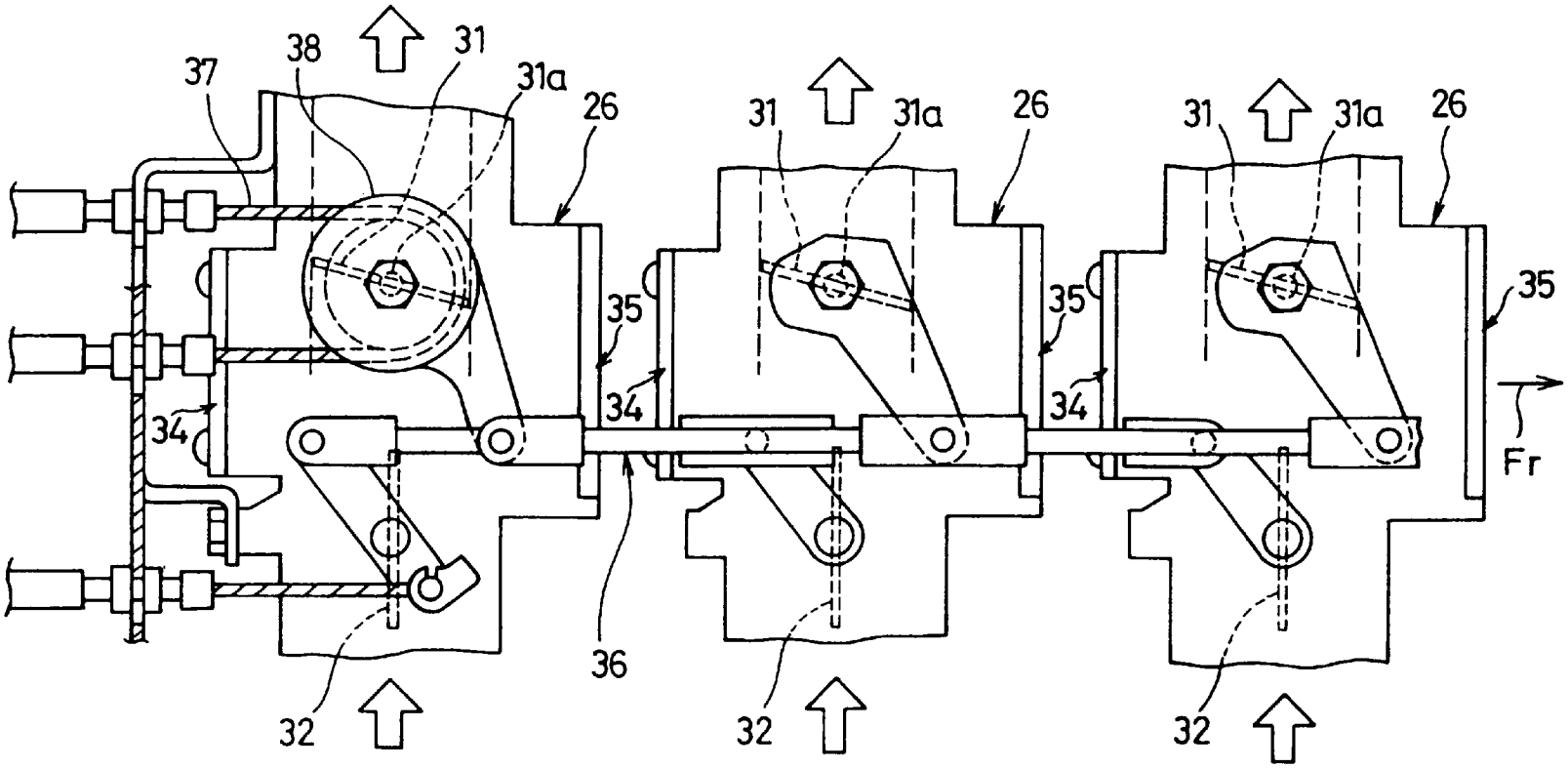
FIG. 9 is a plan view of the carburetors shown in FIG. 8.

FIGS. 7–9 illustrate another embodiment of the invention with a small planing watercraft 1. In these figures, the valve shafts 31*a* of the throttle valves 31 are disposed vertically. A throttle cable sheave 38 is arranged on the top end of one of the valve shafts 31 and is connected to a linkage mechanism 36. In this embodiment, the sheave 38 is located at the rearward end of the linkage mechanism 36. Also, the sheave 38 and the linkage mechanism 36 are positioned above the carburetors 26 where they can be visually inspected and accessed by looking through and reaching through the access opening 11. By moving the seat 5 away from the opening 11, it is possible to reach through the opening 11 and replace the throttle cable 37 and to perform maintenance on the throttle cable and/or sheave 38. Since the sheave 38 can be visually examined through the opening 11, there is no need to grope blindly inside the hull 2 in order to find the sheave and cable mechanism Consequently, replacing the throttle cable 37 or performing other maintenance in the area of the sheave 38 can be more easily accomplished because these parts are not obstructed by other parts of the engine 8. It is therefore possible to assure more precise delivery of fuel from the carburetors 26 to the engine as required for cleaner exhaust emissions. Furthermore, when the watercraft 1 is raced, there is a need for such frequent acceleration and deceleration so that the throttle cable 37 needs to be maintained and replaced more often. The embodiment described above simplifies that operation and makes it easier to maintain cleaner exhaust emissions even on racing personal watercraft.

Figure 10A:
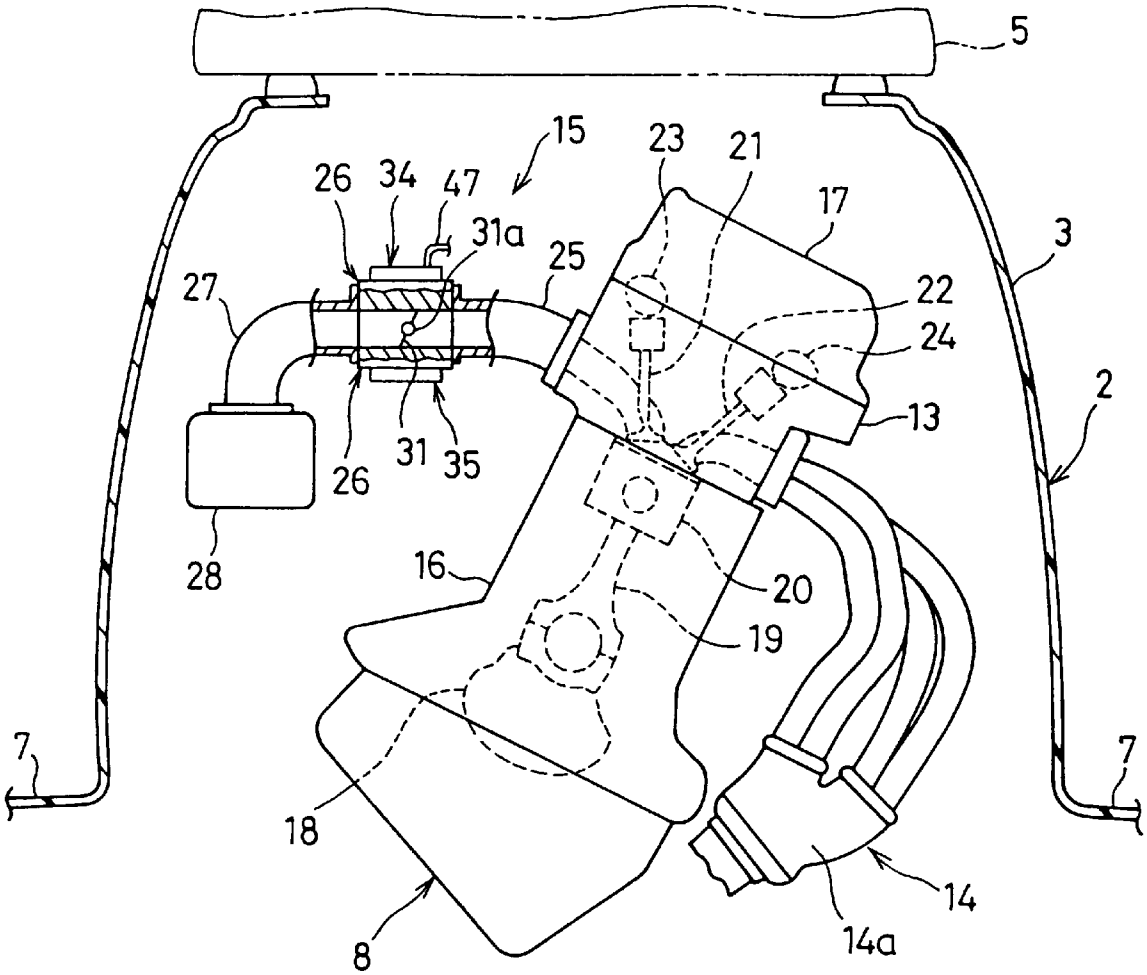
FIG. 10(*a*) is a transverse sectional view of an engine compartment of another embodiment of the invention with a cutaway view of a single carburetor.
Figure 10B:
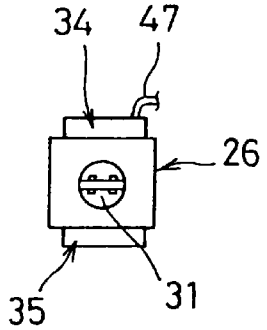
Figure 11:
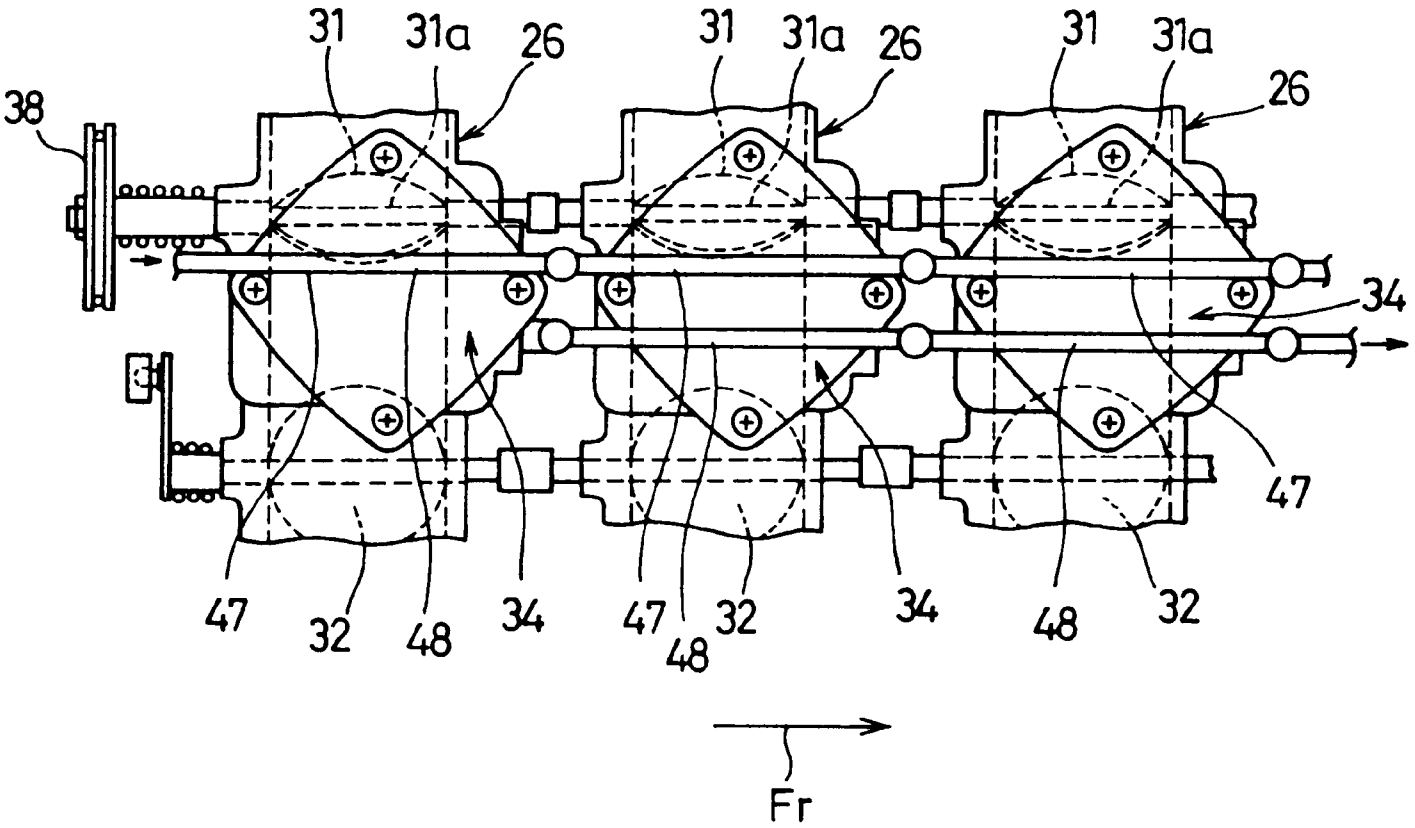
FIG. 11 is a plan view of three carburetors shown in FIG. 10.

FIGS. 10 and 11 show another embodiment of the invention, wherein the valve shafts 31 a of the throttle valves 31 of the carburetors 26 are located so they extend parallel to the crankshaft 18, and the integrated fuel pumps 34 are positioned above the carburetors. In accordance with this embodiment, a valve shaft 31 a passes through all four carburetors 26, and the sheave 38 are attached to the rearward end of this valve shaft 31*a*. Also, the fuel lines 47–49 are positioned above the carburetors where they can be visually examined through the opening 11 over the engine.

With this embodiment, it is also possible to easily inspect and maintain the carburetors 26 and fuel lines 47–49 by removing the seat 5 from the watercraft chassis 2 to provide access to the opening 11.

Furthermore, since there are a large number of cylinders and carburetors in this embodiment, it is easy to bend the fuel lines 47–49 out of the way when making adjustments to the carburetors (such as the idle adjustment screw) before putting them back in place to further facilitate maintenance operations.

Figure 12A:
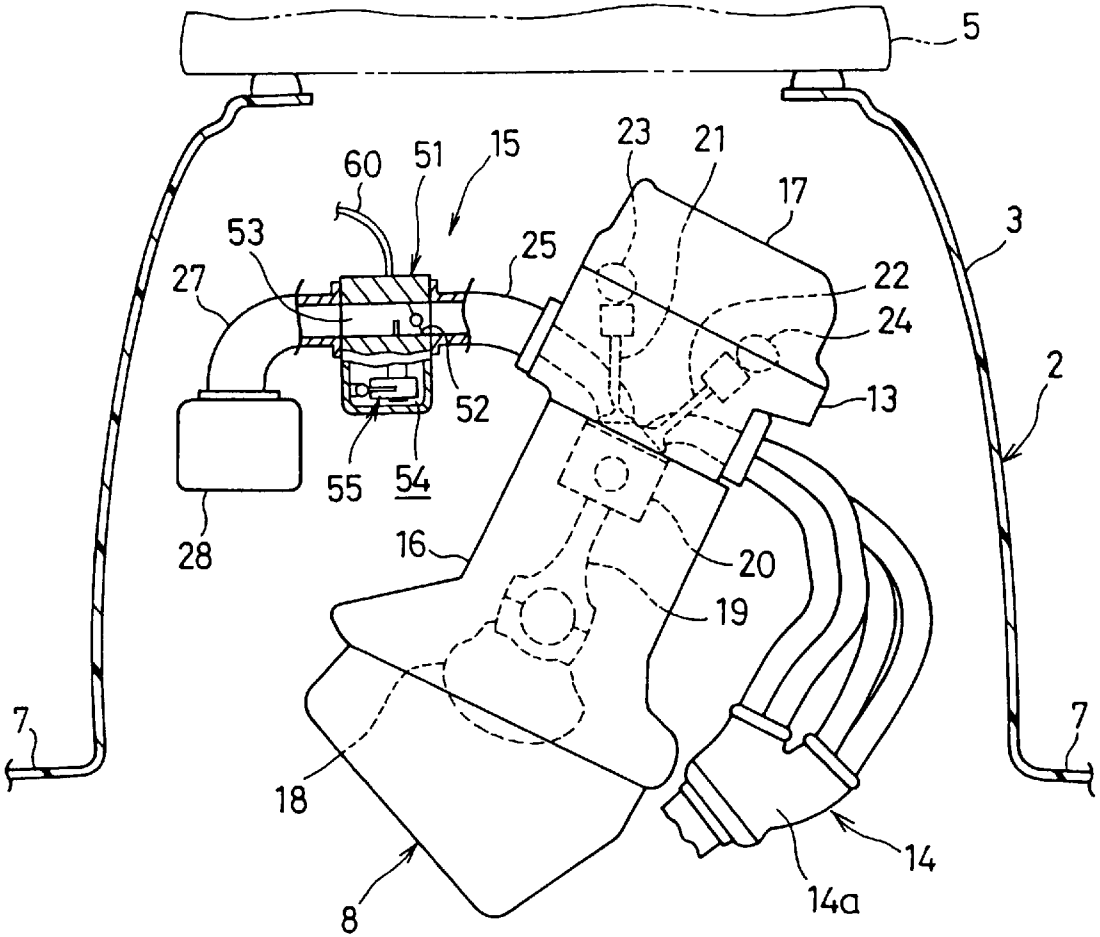
FIG. 12 is a partial transverse sectional view of another embodiment of the invention.
Figure 12B:
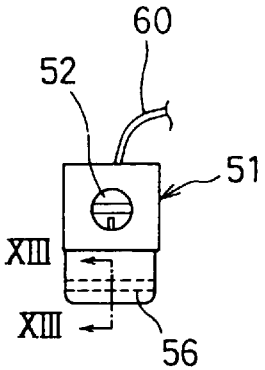
Figure 13:
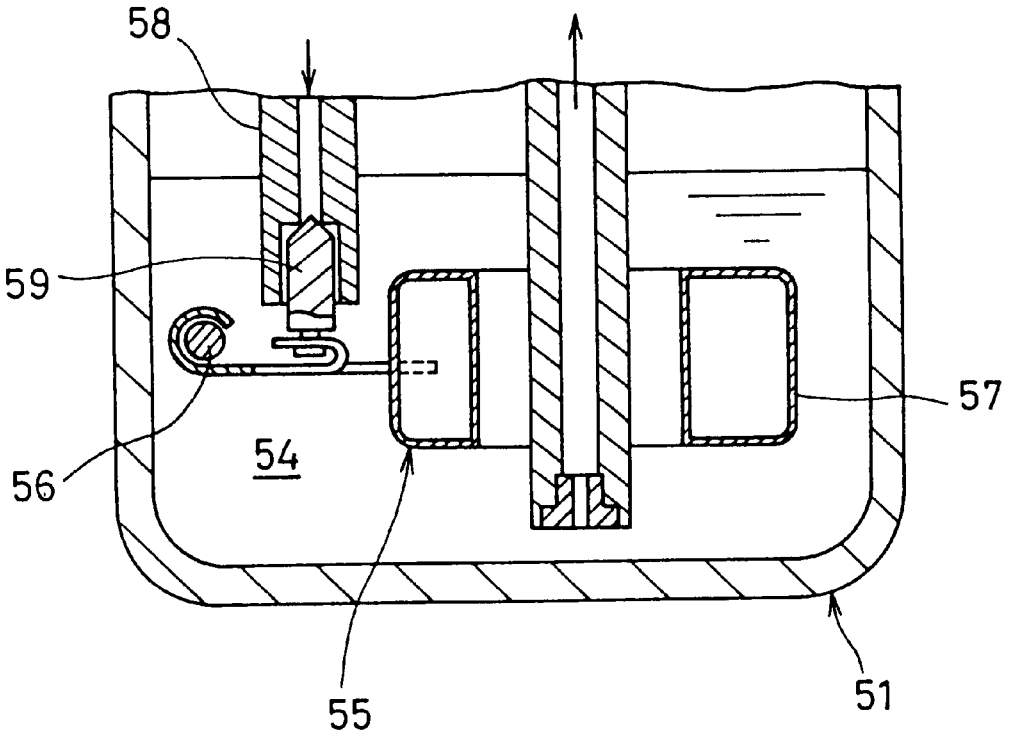
FIG. 13 is a partial sectional detail view of a float chamber of the carburetor shown in FIG. 12.

FIGS. 12 and 13 shown another embodiment of the invention. The air intake and charge preparation apparatus of the small planing watercraft 1 shown in FIG. 12 uses float-type carburetors 51 where floats 55 control the fuel level in fuel bowls or chambers 54. These carburetors 51 are equipped with butterfly-type throttle valves 52. The fuel inside each float chamber 54 lies underneath the air intake passage 53 and is maintained at a constant level by a pivotally mounted float 55 pivoted on shaft 56. The axis of the pivot shaft 56 extends parallel with the fore and aft axis of the watercraft 1. A needle valve 59 is pivotally linked to the movement of a float 55, which pivots on shaft 56 in response to the amount of fuel in the float chamber 54. The vertical pivotal movement of the float 57 causes the valve 59 to open and close the fuel supply opening of the fuel supply line 58. The fuel supply line 58 is connected to the fuel line 60 shown in FIG. 12 for receiving fuel from the fuel tank 10.

In accordance with this embodiment, pitching motion of the boat does not affect the position of the float 57. This structure therefore makes it possible to maintain a constant fuel level in the float chamber 54 which remains unaffected by frequent pitching even if the craft is being run over high waves. Accordingly, the carburetors 51 can precisely control the supply of fuel to the engine 8 to thereby assure cleaner exhaust emissions.

Figure 14A:
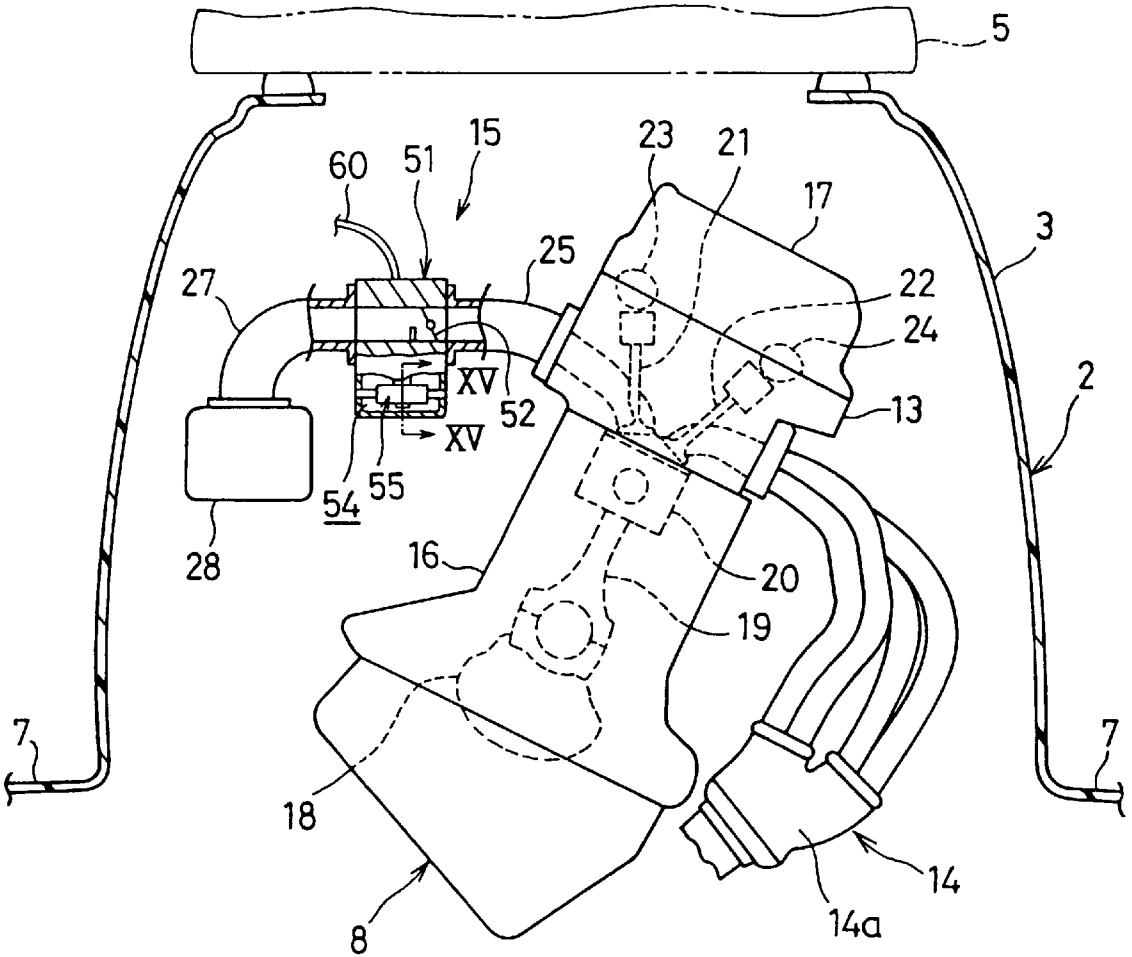
FIG. 14(*a*) is a transverse sectional view of an engine compartment of another embodiment of the watercraft with a transverse partial sectional view of a single carburetor.
Figure 14B:
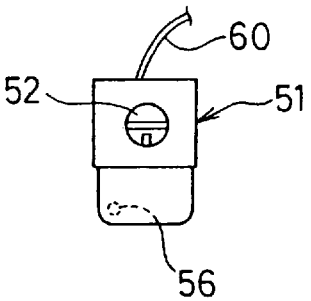
Figure 15:
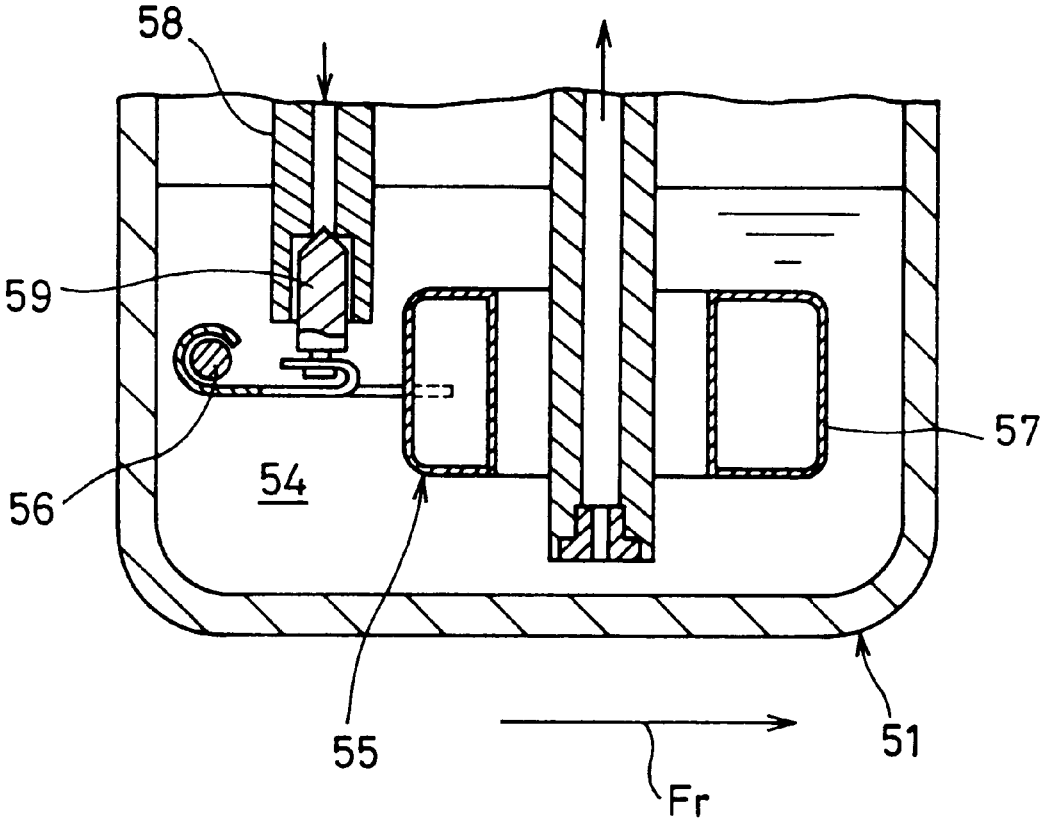
FIG. 15 is a partial sectional detail view of a carburetor float chamber taken along section line XV—XV in FIG. 14.

FIGS. 14 and 15 show another embodiment of the invention. In accordance with this embodiment, the air intake apparatus 15 of the watercraft 1 shown in FIG. 14 uses float-type carburetors 51 which are similar to those of the previous embodiment, except that the axes of the float pivot shafts 56 are each arranged to extend in the transverse direction of the watercraft 1. In accordance with this embodiment, when the craft rolls sideways, for example when making turns, or when it simply rolls side-to-side, the float 57 in the carburetor 51 remains largely unaffected. Accordingly, the precision fuel delivery from the carburetor 51 to the engine 8 that is required for clean exhaust emissions is not affected by the rolling of the watercraft chassis 2. As a result, even when the small watercraft 1 is being raced and is rolled from one side to the other, the flow system will maintain a constant fuel level in the float chamber to allow cleaner exhaust emissions.

To summarize, in accordance with the invention it is possible to reach through an access opening 11 over an engine 8 to easily grasp and straighten or otherwise adjust engine fuel lines that are located below the opening.

Moreover, the invention facilitates a strict maintenance regimen that is required to maintain precision fuel delivery from the carburetors to the engines for cleaner exhaust emissions. In particular, for small planing watercraft using engines having multiple cylinders and multiple carburetors, the use of the inventions facilitates carburetor adjustments (e.g., idle screw adjustments) and maintenance operations, by allowing the numerous fuel lines to be bent out of the way and then to be readily returned to desired positions when the maintenance operation is complete.

Another feature of the invention is that the throttle control cable and the sheave for the carburetors are located in an area where they can be visually examined through the opening preferably directly above the engine in order to facilitate maintenance of the throttle cable, sheave and linkage.

These structures make it possible to maintain precision delivery of fuel from the carburetors to the engines as required for cleaner exhaust emissions, and it is especially easy to make proper throttle cable replacements and adjustments in watercraft that undergo frequent accelerations and decelerations.

By placing the throttle valve shafts so they extend parallel to the crankshaft of the engine and the carburetor pumps above the carburetors where they can be visually examined through the access opening above the engine, and by placing the fuel lines in this same area, it is easy to reach through the opening and grasp the fuel lines in orderto make adjustments, such as reducing the bending radius of the fuel lines. According to this design, maintenance of precise delivery of fuel from the carburetors to the engine is assured along with continued cleaner exhaust emissions. This feature is particularly useful for small planing watercraft employing multiple cylinders with multiple carburetors (facilitating adjustments, for example, of idle screws, etc.) since the fuel lines can be manually moved out of the way and put back in place.

When float type carburetors are connected to four cycle engines for small planing watercraft, placing the axis of each float pivot shaft parallel to the fore and aft direction of the watercraft allows the float movement in the carburetor to remain largely unaffected by the pitching movement of the watercraft. As a result, the fuel delivery from the carburetors to the engine remains unaffected by such pitching, thereby also allowing clean exhaust emissions to be maintained.

According to another embodiment described previously, wherein the axes of the float pivot shafts extend transverse of the watercraft, the float movement remains largely unaffected by the rolling action of the watercraft, for example during turns or other rolling movement. Since the fuel supply of fuel from the carburetors to the engines remains unaffected by the rolling of the watercraft, it is possible to maintain precise fuel delivery and clean exhaust emissions during such rolling movement.

The use of the invention, particularly in watercraft that roll frequently and extremely during racing, makes it possible to maintain stable fuel delivery from the carburetors in order to assure continued clean emissions.

Although the invention was described above with respect to various preferred embodiments, it should be readily understood to one of ordinary skill in the art that various changes and/or modifications may be made without departing from the spirit of the invention. It is intended that the scope of protection for the invention be limited only by the following claims.

What is claimed is:

1. In a small planing personal watercraft including a hull and a straddle-type seat on the hull, a four cycle engine located internally of the hull, the engine having a cylinder head with intake valves and at least one intake tube extending to the head, at least one carburetor in the intake tube for supplying fuel to engine intake air, the carburetor including an upper side and a throttle valve pivotally mounted for rotation about a throttle valve pivot axis for controlling air flow through the intake tube, said carburetor including an integrated fuel pump on one side of the carburetor; the improvement comprising:

an access opening in an upper portion of the hull above the engine;

said intake tube extending approximately horizontally transversely in the hull when the hull is in its normal flotation position;

said throttle valve pivot axis oriented vertically in the carburetor; and said fuel pump located on the upper side of the carburetor, whereby the pumps can be easily accessed through the access opening for maintenance.

2. In a small planing personal watercraft including a hull and a straddle-type seat on the hull, a four cycle engine located internally of the hull, the engine having a cylinder head with intake valves and at least one intake tube extending to the head, at least one carburetor in the intake tube for supplying fuel to the engine intake, the carburetor including an upper side and a throttle valve pivotally mounted for rotation about a throttle valve pivot axis for controlling air flow through the intake tube, a throttle valve sheave operably connected to the throttle valve and a throttle control cable extending to the throttle valve sheave and wound thereon; a throttle on the watercraft connected to the throttle cable and arranged to control the throttle valve via the throttle control cable and throttle valve sheave; the improvement comprising:

an access opening in an upper portion of the hull above the engine;

said intake tube extending approximately horizontally transversely in the hull when the hull is in its normal flotation position;

said pivot axis of said throttle valve oriented vertically in the carburetor; and said control valve sheave positioned above the carburetor where it is accessible for maintenance between the access opening and the carburetor.

3. In a small planing personal watercraft including a hull and a straddle-type seat, a four cycle engine located internally of the hull, the engine having a crankshaft extending longitudinally of the engine, a cylinder head with intake valves and at least one intake tube extending to the head, said intake tube extending approximately horizontally transversely in the hull when the hull is in its normal flotation position, at least one carburetor in the intake tube for supplying fuel to the engine intake air, the carburetor including a throttle valve pivotally mounted for rotation about a throttle valve pivot axis for controlling air flow through the intake tube, and including at least one portion of a fuel line for supplying fuel to the carburetor, the improvement comprising:

an access opening in an upper portion of the hull above the engine;

said pivot axis of said throttle valve oriented parallel with the engine crankshaft; and said fuel line portion being located above the carburetor where it is accessible for maintenance between the access opening and the carburetor.

4. The improvement according to claim 3 wherein said carburetor includes an upwardly facing side and an integrated fuel pump on said upwardly facing side, whereby said pump is accessible via said access opening.

5. The improvement according to any one of claims 1, 2 or 3, wherein said seat is movable and lies atop a deck area of the hull, and said access opening is located beneath said seat.

6. In a small planing personal watercraft including a hull and a straddle-type seat, a four cycle engine located internally of the hull, the engine having a cylinder head with intake valves and at least one intake tube extending to the head, said intake tube extending approximately horizontally transversely in the hull when the hull is in its normal flotation position, at least one carburetor in the intake tube for supplying fuel to the engine intake, the carburetor including a throttle valve pivotally mounted for rotation about a throttle valve pivot axis for controlling air flow through the intake tube, and including at least one portion of a fuel line for supplying fuel to the carburetor, said carburetor including a fuel bowl containing a fuel level control float and a fuel flow control valve connected to the float and arranged so that the flow of fuel to the bowl is controlled by the angular position of the float, said float pivotally mounted for rotation about a float pivot axis; the improvement comprising:

the float pivot axis extending parallel to the fore-aft direction of the watercraft.

7. In a small planing personal watercraft including a hull and a straddle-type seat on the hull, a four cycle engine located internally of the hull, the engine having a cylinder head with intake valves and at least one intake tube extending to the head, said intake tube extending approximately horizontally transversely in the hull when the hull is in its normal flotation position, at least one carburetor in the intake tube for supplying fuel to the engine intake, the carburetor including a throttle valve pivotally mounted for rotation about a throttle valve pivot axis for controlling air flow through the intake tube, and including at least one portion of a fuel line for supplying fuel to the carburetor, said carburetor including a fuel bowl containing a fuel level control float and a fuel flow control valve connected to the float and arranged so that the flow of fuel to the bowl is controlled by the angular position of the float, said float pivotally mounted for rotation about a float pivot axis; the improvement comprising:

the float pivot axis of said float extending transversely of the hull of the watercraft.

8. The improvement according to claims 6 or 7, wherein said seat is moveable and lies atop a deck area of the hull, and including an access opening under the seat and above the engine and carburetor.

* * * * *